US007652525B2

(12) United States Patent
Minami

(10) Patent No.: US 7,652,525 B2
(45) Date of Patent: Jan. 26, 2010

(54) CURRENT MIRROR CIRCUIT

(75) Inventor: Yukimasa Minami, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/070,965

(22) Filed: Feb. 22, 2008

(65) Prior Publication Data

US 2008/0224737 A1 Sep. 18, 2008

(30) Foreign Application Priority Data

Feb. 24, 2007 (JP) ..... 2007-044778

(51) Int. Cl.
*G05F 1/10* (2006.01)

(52) U.S. Cl. ..... 327/538; 327/541; 327/543; 327/525

(58) Field of Classification Search ..... 327/538–541, 327/543, 525; 323/313, 315
See application file for complete search history.

(56) References Cited

U.S. PATENT DOCUMENTS 5,757,175 A * 5/1998 Morishita et al. ..... 323/315
5,856,215 A * 1/1999 Jung ..... 438/199

FOREIGN PATENT DOCUMENTS

JP 2001175343 7/2001

* cited by examiner

*Primary Examiner*—Long Nguyen
(74) *Attorney, Agent, or Firm*—Adams & Wilks

(57) ABSTRACT

A current mirror circuit has a first MOS transistor to which an input current is supplied. The first MOS transistor has a gate formed of polysilicon. A second MOS transistor has a gate formed of polysilicon and connected directly to the gate of the first MOS transistor via a polysilicon layer for producing an output current whose magnitude is a magnitude of the input current multiplied by a current mirror ratio. A fuse has one terminal connected to a gate portion between the gate of the first MOS transistor and the gate of the second MOS transistor and another terminal that is grounded.

7 Claims, 4 Drawing Sheets

Prior Art

CURRENT MIRROR CIRCUIT

BACKGROUND OF THE INVENTION

1. Field of the Invention

The present invention relates to a method of forming a current mirror circuit that suppresses a deviation in mirror ratio of the current mirror circuit.

2. Description of the Related Art

FIG. 7 is a basic circuit configuration diagram showing a current mirror circuit of a conventional art. As shown in FIG. 7, there is known a current mirror circuit including two p-type MOS transistors 301 and 302. The MOS transistor 301 has a source connected to a current source 303 and has a gate 307 connected to a drain, and a common connecting portion therebetween is grounded. Further, the MOS transistor 302 has a gate 308 connected to the gate of the MOS transistor 301, a source connected to the current source 303, and a drain 304 as an output terminal. Interconnection between terminals is made by a metal line such as a metal interconnect 312 as shown in FIG. 7.

In the current mirror circuit having the above-mentioned configuration, an input current i1 is supplied to the source of the MOS transistor 301 from the current source 303. An output current i2 flowing through the source of the MOS transistor 302 is controlled by a voltage applied to the gate thereof. A ratio i2/i1 (current mirror ratio) between the input current i1 and the output current i2 is determined based on a ratio of transistor size W/L's between the MOS transistor 301 and the MOS transistor 302. In this case, W represents a gate width of a MOS transistor and L represents a gate length of a MOS transistor. For example, when the ratio between the MOS transistor 301 and the MOS transistor 302, which form the current mirror circuit, is 1:100, a current 100 times as much as a current flowing through the MOS transistor 301 flows through the MOS transistor 302 (for example, see JP 2001-175343 A).

However, while the current mirror ratio i2/i1 is determined by the sizes of the MOS transistors, there is a problem in that the current mirror ratio i2/i1 deviates from a desired value in many cases due to process variation and nonuniformity over a surface of a semiconductor substrate. For one reason, there occurs a deviation in threshold voltage caused by charging to the gate during production process (in-process). This is because the potentials of gates of the adjacent MOS transistors forming a current mirror circuit are floating until the gates are connected to each other via a metal interconnect, and because the degree of influence of the charge varies according to gate area.

SUMMARY OF THE INVENTION

The present invention has been made in view of the above-mentioned circumstances, and it is an object of the present invention to provide a method of forming a current mirror circuit capable of obtaining a current mirror ratio with high accuracy by reducing an effect of charge caused in-process.

In order to solve the above-mentioned problem, the present invention employs the following means:

(1) a current mirror circuit including: a first MOS transistor to which an input current is supplied; and a second MOS transistor having a gate connected to a gate of the first MOS transistor, for outputting a current for mirroring the input current, characterized in that: the gate of the first MOS transistor and the gate of the second MOS transistor are each formed of polysilicon; and the gate of the first MOS transistor and the gate of the second MOS transistor are directly connected to each other with the polysilicon;

(2) a current mirror circuit further including a fuse, characterized in that: one end of the fuse is connected to a gate portion between the gate of the first MOS transistor and the gate of the second MOS transistor, which are directly connected to each other with the polysilicon; and another end of the fuse is grounded to a substrate; and (3) a current mirror circuit, characterized in that the fuse is cut off during a trimming process, which is executed after a production process of the current mirror circuit, is finished.

As described above, in the present invention, the gates of the adjacent MOS transistors forming the current mirror circuit are directly connected to each other with the polysilicon, and the fuse connected to the substrate is connected to the gate portion, whereby the effect of the charge on each gate of the adjacent MOS transistors in-process can be evenly distributed. As a result, the deviation in threshold value can be reduced.

DETAILED DESCRIPTION OF THE PREFERRED EMBODIMENT

Figure 2:
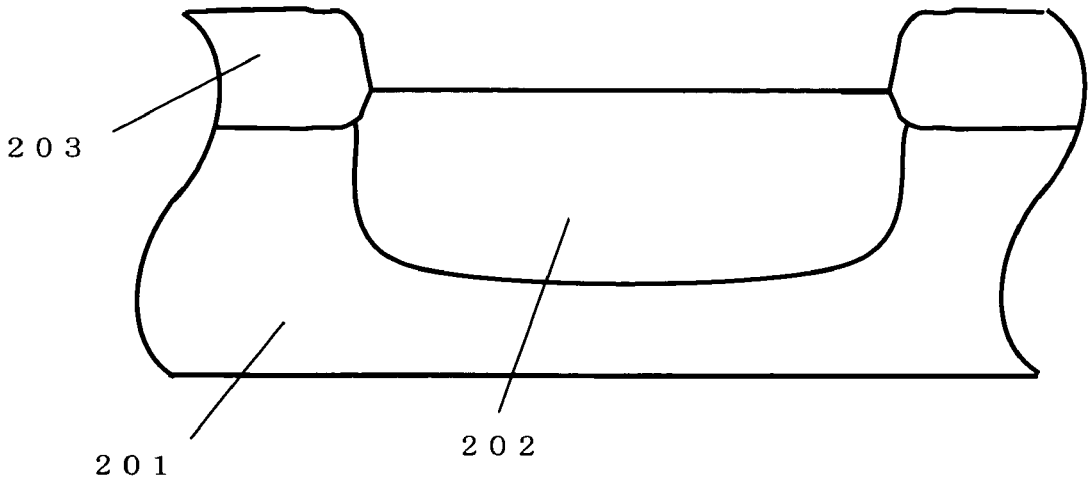
FIG. 2 is a step sequence sectional diagram schematically showing a method of producing the semiconductor device according to the present invention.
Figure 3:
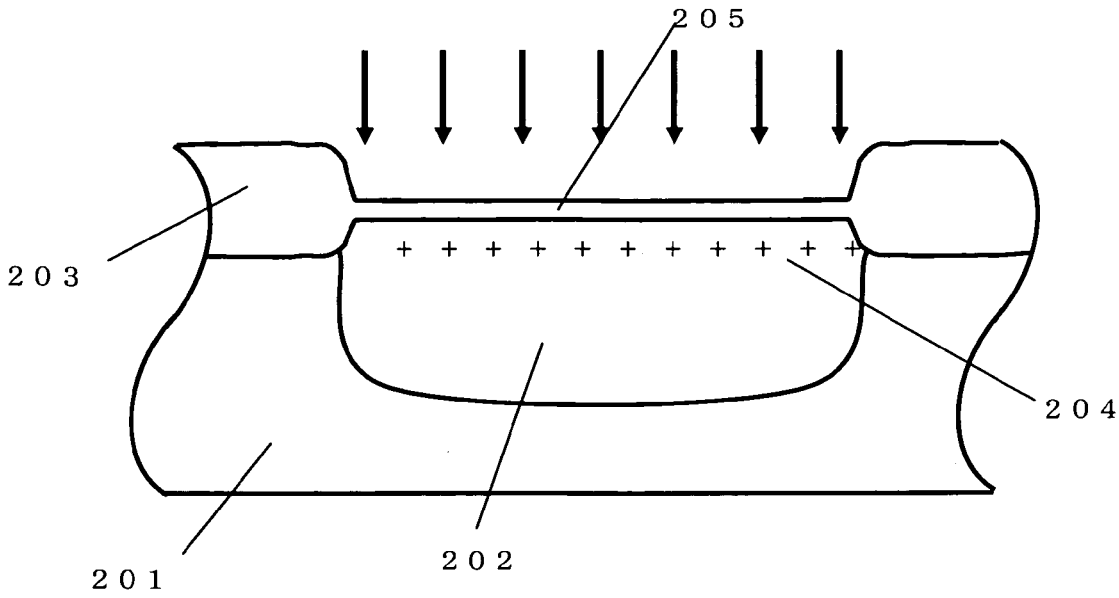
FIG. 3 is a step sequence sectional diagram schematically showing the method of producing the semiconductor device according to the present invention.
Figure 4:
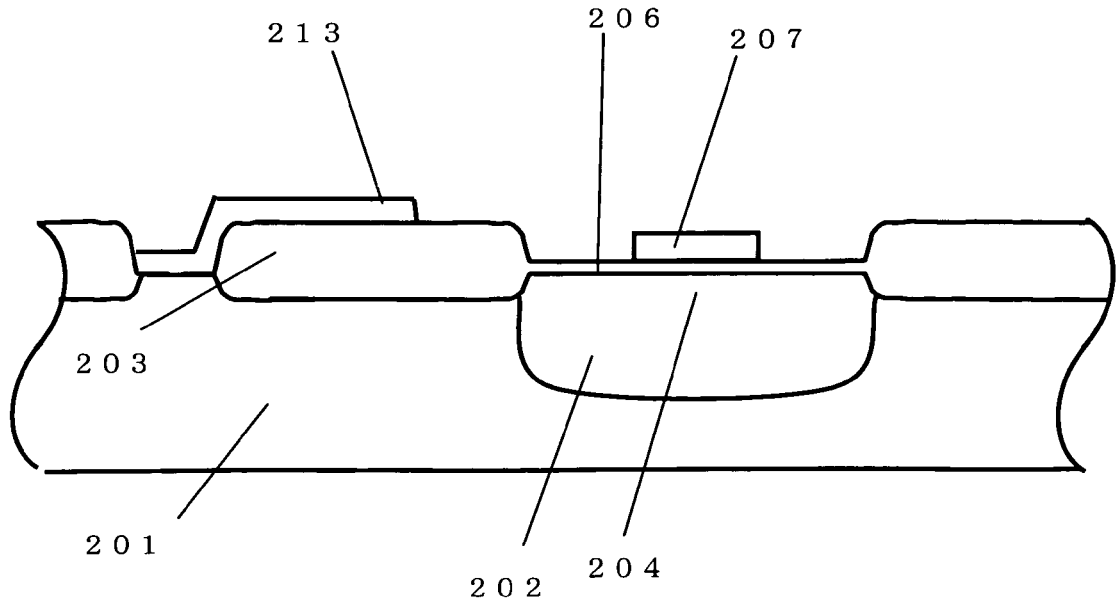
FIG. 4 is a step sequence sectional diagram schematically showing the method of producing the semiconductor device according to the present invention.
Figure 5:
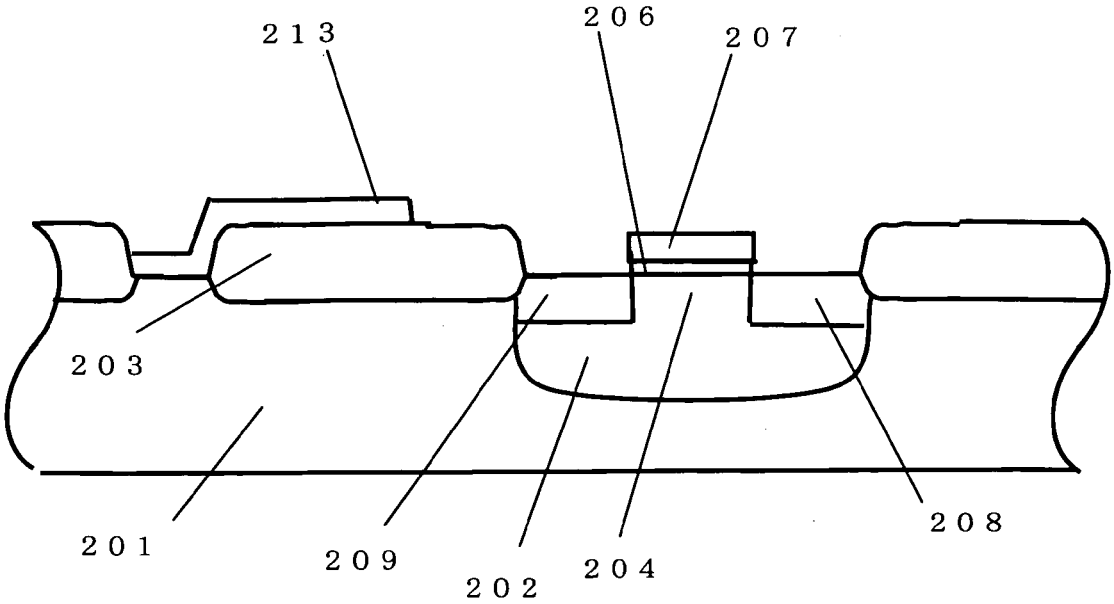
FIG. 5 is a step sequence sectional diagram schematically showing the method of producing the semiconductor device according to the present invention.
Figure 6:
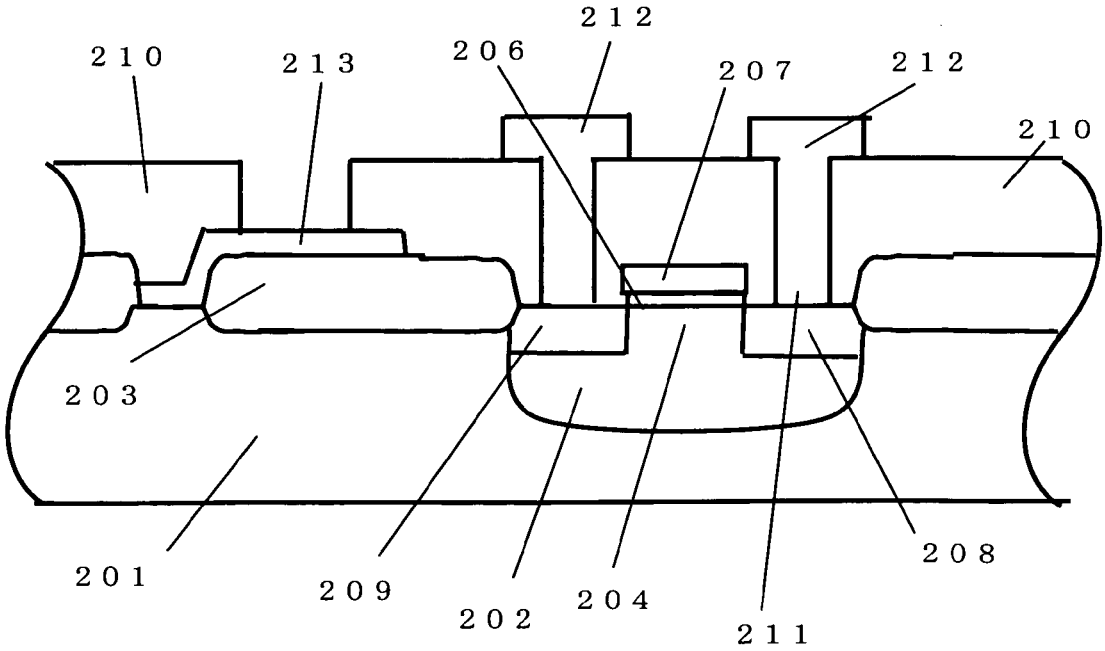
FIG. 6 is a step sequence sectional diagram schematically showing the method of producing the semiconductor device according to the present invention.
Figure 7:
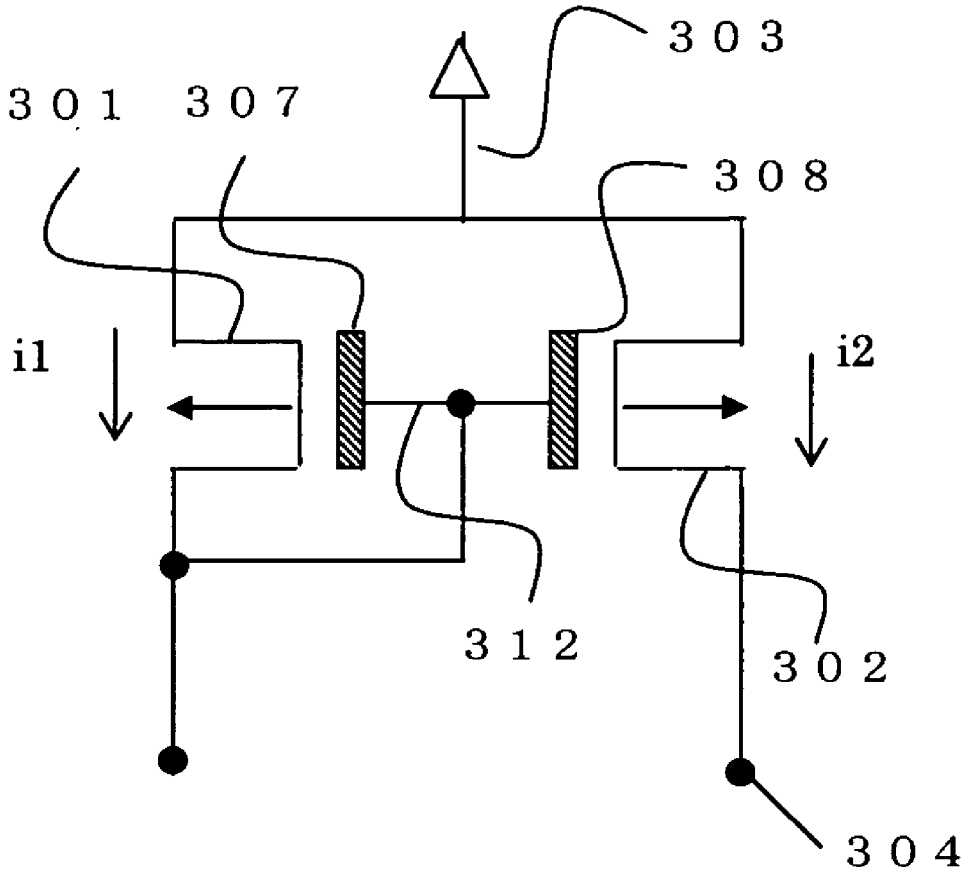
FIG. 7 is a circuit diagram showing a semiconductor device according to a conventional art.

Hereinafter, an embodiment of the present invention will be described with reference to the drawings. First, with reference to FIGS. 2 to 6, a description is given to an exemplary outline of a method of producing MOS transistors which form a current mirror circuit according to the embodiment of the present invention. As shown in FIG. 2, a well 202 is formed in a semiconductor substrate 201, and, for example, a thermal oxide film having a thickness of several hundred nm is formed as a field insulating film 203 through the LOCOS process. Then, the insulating film on a region forming the MOS transistor is removed, to thereby form a channel forming portion 204. After that, as shown in FIG. 3, a sacrificial oxide film 205 is grown to a thickness of, for example, 15 nm on the semiconductor substrate 201. Then, the channel forming portion 204 is subjected to ion implantation for adjustment of a threshold voltage. Next, as shown in FIG. 4, after the sacrificial oxide film 205 is etched with a hydrofluoric acid (HF) based solution, a gate insulating film 206 is grown to a thickness of, for example, several tens nm, and a polysilicon 207 is deposited on the gate insulating film 206. Then, impurities are introduced by predeposition or ion implantation and patterning is performed to form a gate electrode 207 of polysilicon. Subsequently, as shown in FIG. 5, in order to form a drain high concentration region 208 and a source high concentration region 209 at both ends of the polysilicon gate electrode 207, boron ions are implanted at a dosage of $1\times10^{14}$ to $1\times10^{16}$ atoms/cm$^2$. Then, as shown in FIG. 6, an interlayer dielectric film 210 is deposited to a thickness of about 200 nm to 800 nm so as to form contact holes 211 for the source high concentration region 209 and for the drain high concentration region 208 to connect with metal interconnects.

Next, a wiring metal is deposited by sputtering or the like and patterning is performed, whereby wiring metals 212 are connected to each surface of the drain high concentration region 208 and the source high concentration region 209 through the contact holes 211.

Figure 1:
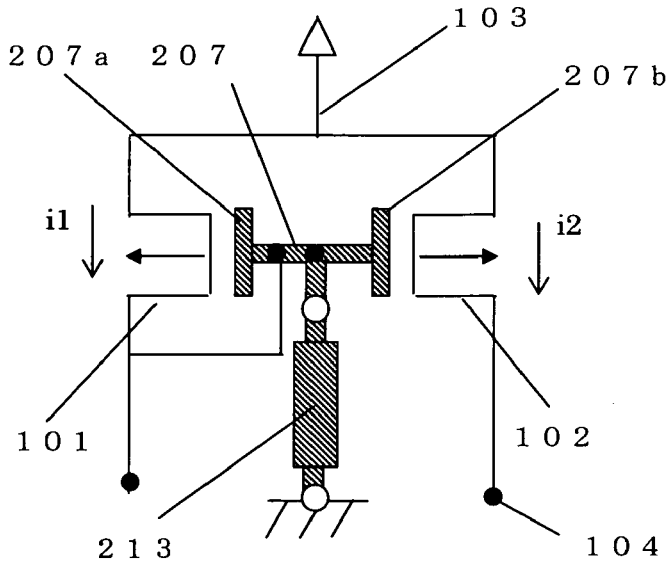
FIG. 1 is a circuit diagram showing a semiconductor device according to an embodiment of the present invention.

FIG. 1 is a configuration diagram showing the current mirror circuit according to the present invention, which is formed by the above-mentioned production process. Each of a MOS transistor 101 and a MOS transistor 102 has a source connected to a current source 103. A drain 104 of the MOS transistor 102 is an output terminal. As shown in FIG. 1, in a production step shown in FIG. 4, a gate 207*a* and a gate 207*b* of the MOS transistor 101 and the MOS transistor 102, respectively, which are adjacent to each other, are directly connected to each other with the polysilicon 207. When the gate 207*a* and the gate 207*b* are thus connected to each other, an effect of charge, which is caused in-process, for example, when planarization is performed before the formation of the wiring metals 212 or when the wiring metals 212 are formed by sputtering or the like and patterning is performed, can be evenly distributed to each of the gate 207*a* of the MOS transistor 101 and the gate 207*b* of the MOS transistor 102. As a result, a deviation in threshold value can also be reduced. A predetermined amount of current can thus be obtained from the output terminal 104.

Further, a fuse 213 directly connected to a substrate is formed on the field insulating film 203, which is formed by the LOCOS process, with the polysilicon 207, and is connected to a gate electrode portion between the gate 207*a* and the gate 207*b* which are directly connected with the polysilicon 207. As a result, the charge applied to the gate electrode portion between the gate 207*a* and the gate 207*b* in-process can be dissipated to the semiconductor substrate 201 with efficiency. When a production process of a semiconductor wafer is finished, the fuse 213 completes its role. Accordingly, as long as the fuse 213 is cut off during a trimming process which is one of subsequent inspection steps, there occurs no problem in performance of an IC.

What is claimed is:

1. A current mirror circuit, comprising:

a first MOS transistor to which an input current is supplied, the first MOS transistor having a gate formed of polysilicon;

a second MOS transistor having a gate formed of polysilicon and connected directly to the gate of the first MOS transistor via a polysilicon layer for producing an output current whose magnitude is a magnitude of the input current multiplied by a current mirror ratio; and a fuse having one terminal connected to a gate portion between the gate of the first MOS transistor and the gate of the second MOS transistor and another terminal that is grounded.

2. A current mirror circuit according to claim 1; wherein the fuse comprises a removable fuse that it is cut off during a trimming process performed after finishing a production process of the current mirror circuit.

3. A current mirror circuit comprising:

a pair of MOS transistors each having a gate formed of polysilicon;

a polysilicon element directly interconnecting the gates of the MOS transistors to one another; and a fuse having one terminal connected to the polysilicon element and another terminal connected to a ground.

4. A current mirror circuit according to claim 3; wherein the fuse comprises a removable fuse that it is cut off during a trimming process performed after finishing a production process of the current mirror circuit.

5. A current mirror circuit according to claim 3; wherein each of the MOS transistors is connected to a current source that provides an input current; and wherein the polysilicon element interconnects the gates of the MOS transistors to one another to produce an output current whose magnitude is a magnitude of the input current multiplied by a current mirror ratio.

6. A current mirror circuit according to claim 3; wherein the pair of MOS transistors comprises a first MOS transistor and a second MOS transistor; wherein the first MOS transistor has a source connected to a current source and a drain connected to the gate thereof; and wherein the second MOS transistor has a source connected to the current source and a drain connected to an output terminal.

7. A current mirror circuit according to claim 3; wherein the one terminal of the fuse is connected to a central part of the polysilicon element.

* * * * *